United States Patent [19]

Ellis

[11] 4,292,688

[45] Oct. 6, 1981

[54] LATCH MECHANISMS

[75] Inventor: Stafford M. Ellis, East Preston, England

[73] Assignee: Elliott Brothers (London) Limited, Chelmsford, England

[21] Appl. No.: 54,423

[22] Filed: Jul. 3, 1979

[30] Foreign Application Priority Data

Jul. 11, 1978 [GB] United Kingdom ..... 29428/78

[51] Int. Cl.[3] ..... A42B 3/00

[52] U.S. Cl. ..... 2/6; 16/145

[58] Field of Search ..... 2/6, 10, 424, 8; 16/139, 144, 145, 146, 147

[56] References Cited

U.S. PATENT DOCUMENTS 2,860,343 11/1958 Aileo ..... 2/6 X
3,748,657 7/1973 Aileo ..... 2/6
3,897,608 8/1975 Impicciche ..... 16/145
4,199,823 4/1980 Jenkins et al. ..... 2/6 X

*Primary Examiner*—Peter P. Nerbun
*Attorney, Agent, or Firm*—Kirschstein, Kirschstein, Ottinger & Cobrin

[57] ABSTRACT

A latch mechanism for controlling relative movement of two hinged members about an axis, e.g. a helmet and visor. The mechanism comprises a first part (19) fixed to one hinged member and a second part comprising a first member (25) fixed to the other hinged member (13) and a manually operable second member (27). On application of pressure the second member (27) pivots on the first member (25) against a spring bias (43) to disengage the second member from the first part (19) and allow the second latch part (25, 27) to move angularly with respect to the first latch part (19) under continuing pressure on the second member.

7 Claims, 5 Drawing Figures

V
47
27
35
25B
39B
33
25A
39A
31
35
35
IV
IV
41
43
49A
49B
19
45
25
V
X
23
29
29
13

27
47
35
25A
33
39A
31
35
49A
19
25
45
41
43
25B
35
39B
49B
X
29
29
13

LATCH MECHANISMS

BACKGROUND OF THE INVENTION

This invention relates to latch mechanisms and is especially, but not exclusively, concerned with latch mechanisms for visors on helmets e.g. aircrew helmets.

Commonly the visors of such helmets pivot about hinges between an operational and a stowed position and rely on friction at the hinges to hold a visor in any desired position within its full range of movement, thus allowing visor position to be altered by a single rotational movement. However, with visors for use under severe environmental forces the force required to hold a visor in position is such that it is desirable to provide means whereby the holding force can be reduced to facilitate movement of the visor to a new position, thus requiring separate manual operations to release and reposition the visor and secure it in its new position.

SUMMARY OF THE INVENTION

It is an object of the present invention to provide a latch mechanism suitable for use with a helmet visor whereby the visor can be released and repositioned and secured in its new position by a single manual operation.

According to the present invention there is provided a latch mechanism for controlling the relative movement of two hinged members about an axis comprising: a first part fixed, or adapted to be fixed, to one of the two hinged members; a second part comprising a first member fixed, or adapted to be fixed, to the other of said two hinged members, and a manually operable second member having two spaced portions adapted to contact spaced reaction surfaces on said first member; and a spring arrangement which biasses said spaced portions and reaction surfaces towards contact with one another; the second member having a surface which engages a surface of the first latch part under the action of the spring arrangement, and the arrangement being such that pressure applied to the manually operable second member of the second latch part is reacted at one or other of the reaction surfaces accordingly as the applied pressure acts in a sense clockwise or counterclockwise about the hinge axis to cause said second member to pivot against the bias of the spring arrangement about one or the other of its spaced portions with the result that the engaged surfaces are disengaged and under continuing pressure at its second member the said second latch part moves angularly with respect to the said first latch part.

The engageable surfaces of the first latch part and the second member of the second latch part may be toothed surfaces.

Friction means may be provided which whilst permitting easy relative motion between the two latch parts nevertheless offers sufficient resistance to such motion that the engageable parts are disengaged when pressure is applied to the manually operable second member of the said second part.

One latch mechanism in accordance with the invention will now be described by way of example with reference to the accompanying drawings in which:

DETAILED DESCRIPTION OF THE INVENTION

Figure 1:
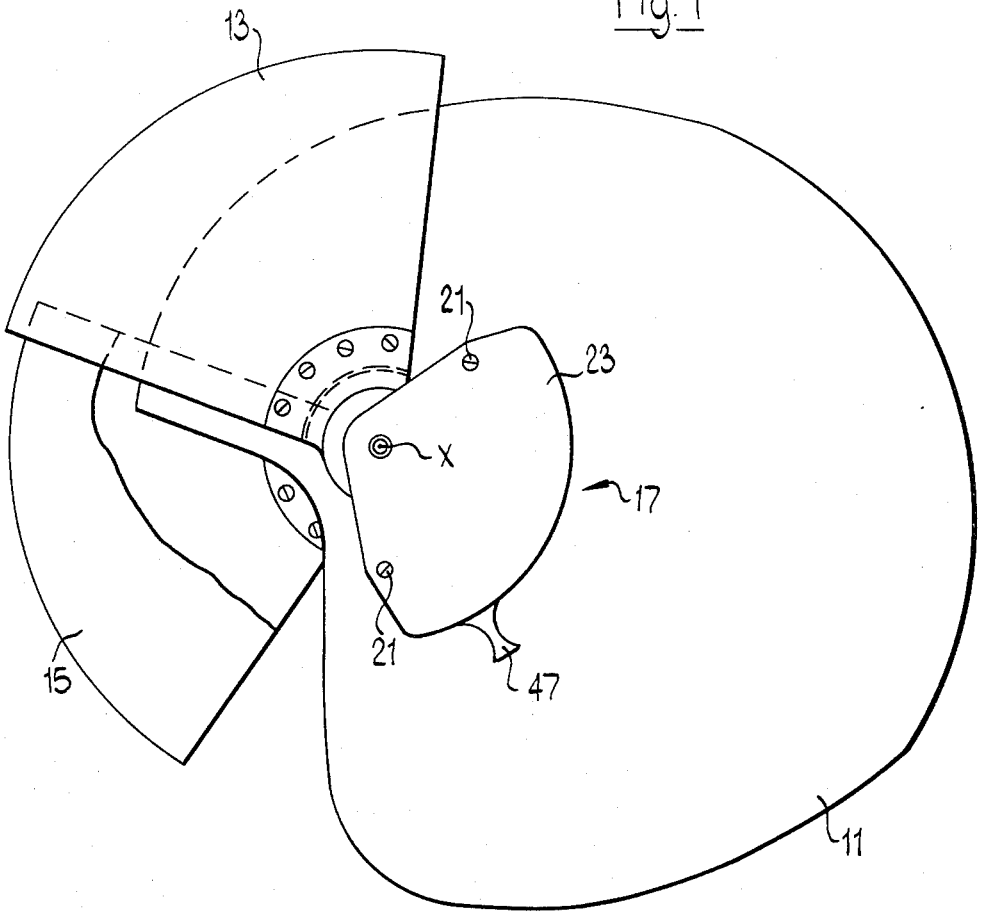
FIG. 1 is a diagrammatic side view of an aircrew helmet incorporating the mechanism.

Referring to FIG. 1, the helmet 11 has a clear visor 13 and a sun visor 15, the visors 13, 15 pivoting about a common axis X; the helmet on the one hand and the two visors on the other constituting two hinged members. The angular position of the clear visor 13 is controlled by a latch mechanism 17 on one side of the helmet 11; the angular position of the sun visor 15 is controlled by an identical latch mechanism (not shown) on the other side of the helmet 11.

The visors 13, 15 and their latch mechanisms together constitute demountable units adapted to be secured to the helmet 11.

Referring now also to FIGS. 2 to 5 which show the latch mechanism 17, each latch mechanism comprises first and second parts housed in a protective casing 23 of hard plastics material.

The first latch part is in the form of a toothed sector 19 and is secured to the helmet by screws 21 (see FIG. 1) which also secure the casing 23.

The second latch part comprises a first member in the form of a generally planar lever 25 hinged to the helmet 11 on axis X and a second member in the form of a manual operating lever 27.

The visor 13 is secured to the lever 25 on one side of the axis X by screws 29, the side wall of the casing being partly cut away to accommodate the part of the lever 25 to which the visor is secured. On the other side of the axis X the lever 25 extends outwardly to the toothed sector 19 where it forks to provide two limbs A and B whose outside edges are provided with slots 39A and 39B whose edges provide spaced reaction surfaces 49A and 49B respectively whose purpose is hereafter explained.

The operating lever 27 comprises two plates 31 and 33 respectively positioned above and below the forked part of the lever 25 and secured together by screws 35. The lower plate 33 has two spaced upwardly projecting portions 37A and 37B (see FIG. 4) which fit into slots 39A and 39B provided in the outside edges of the limbs A and B respectively of the lever 25, the lever 25 extending through the gap between plates 31 and 33 provided by the projections 37A, 37B.

Adjacent the toothed sector 19 the plate 33 has a toothed surface 41 which meshes with the toothed sector 19 under the action of a spring 43 anchored at one end to the central screw 35 and at the other end to a post 45 on the lever 25.

At its end remote from the sector 19 the plate extends through a further cut-out in the casing side wall and, outside the casing, is shaped to provide a knob 47 for operating the mechanism.

Figure 2:
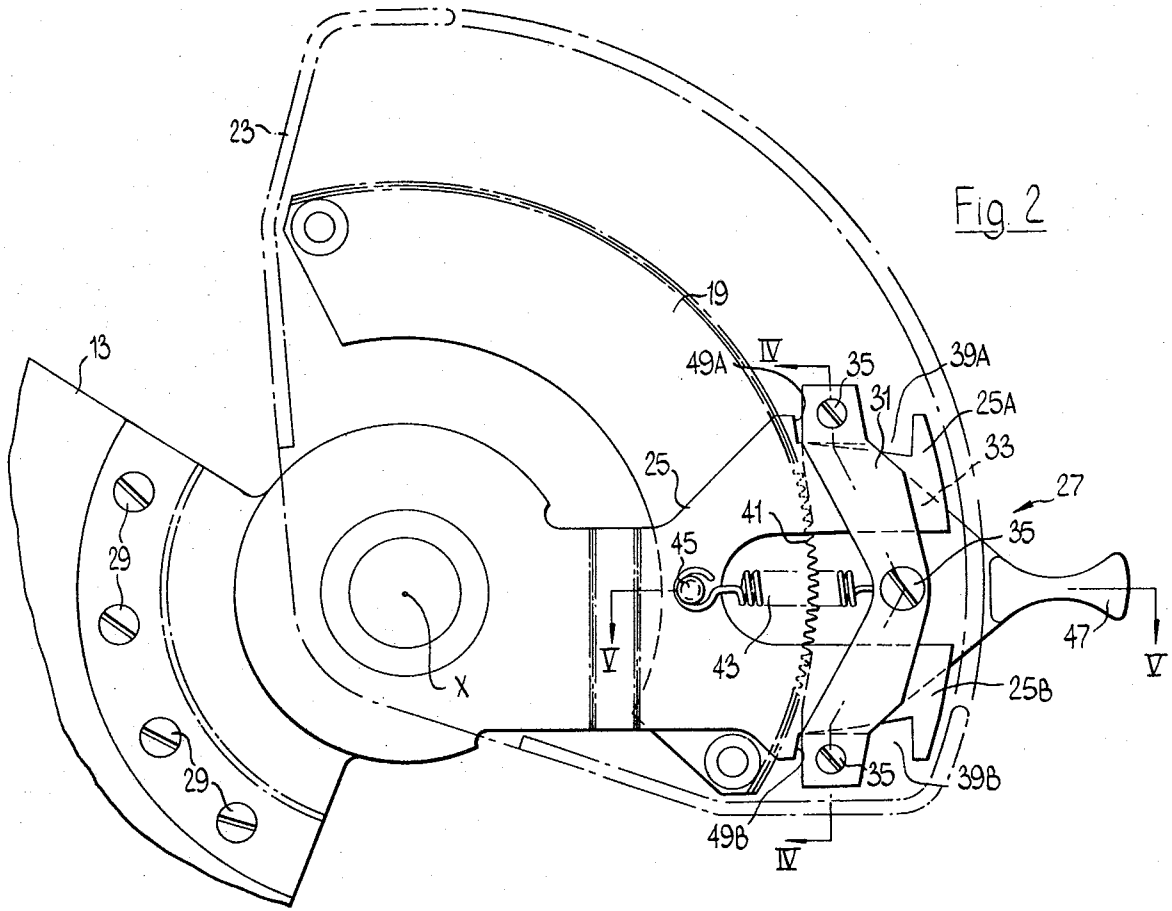
FIG. 2 illustrates the construction of the mechanism the mechanism being in the latched condition.

With the mechanism latched the visor 13 is held in position by virtue of engagement of the teeth of sector 19 and surface 41, as shown in FIG. 2.

Figure 3:
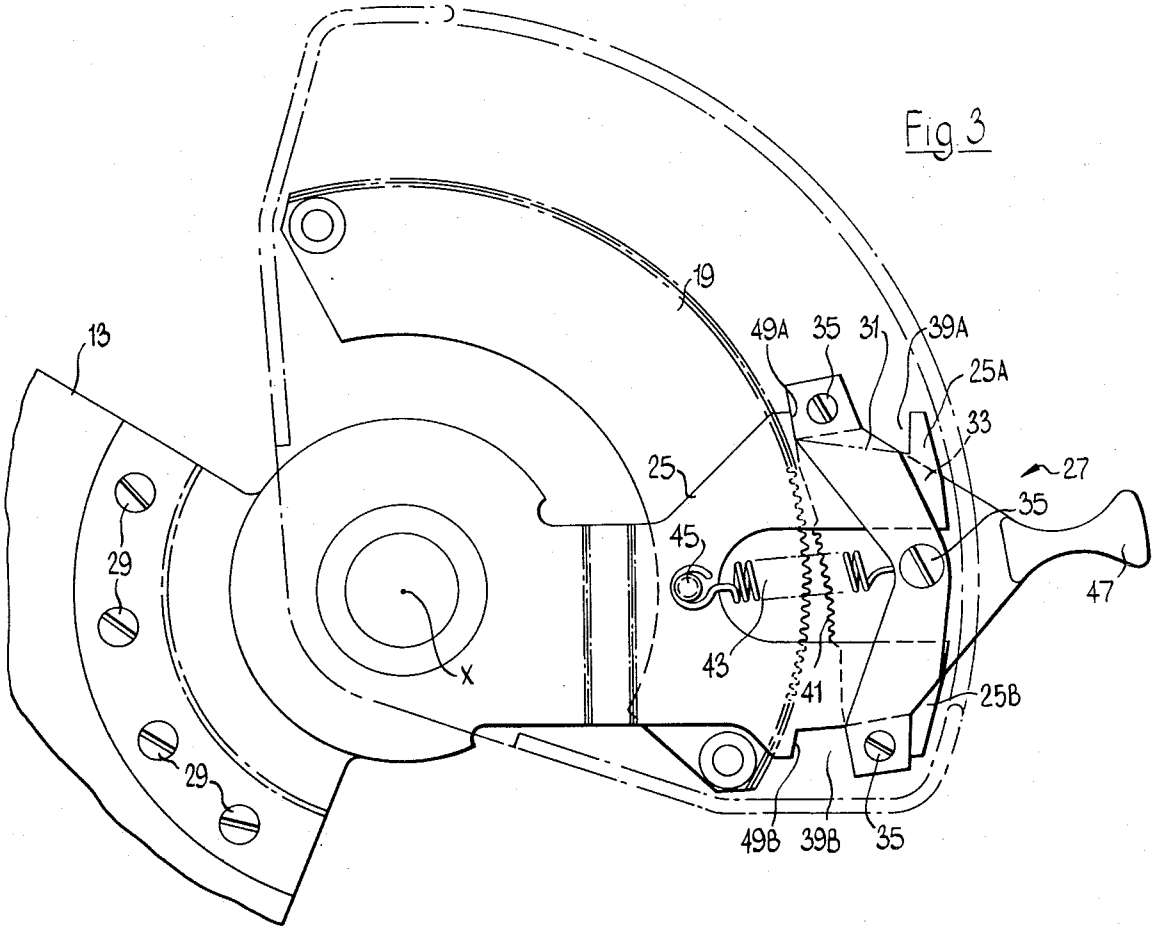
FIG. 3 corresponds to FIG. 2 but shows the mechanism in the unlatched condition.
Figure 4:
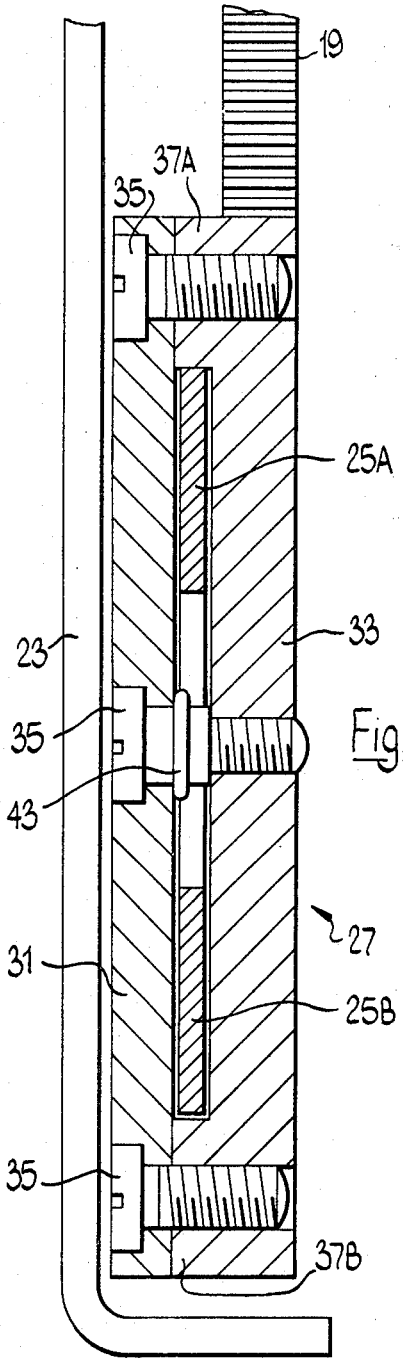
FIGS. 4 and 5 are enlarged sectional views of parts on the lines IV—IV and V—V in FIG. 2 respectively.
Figure 5:
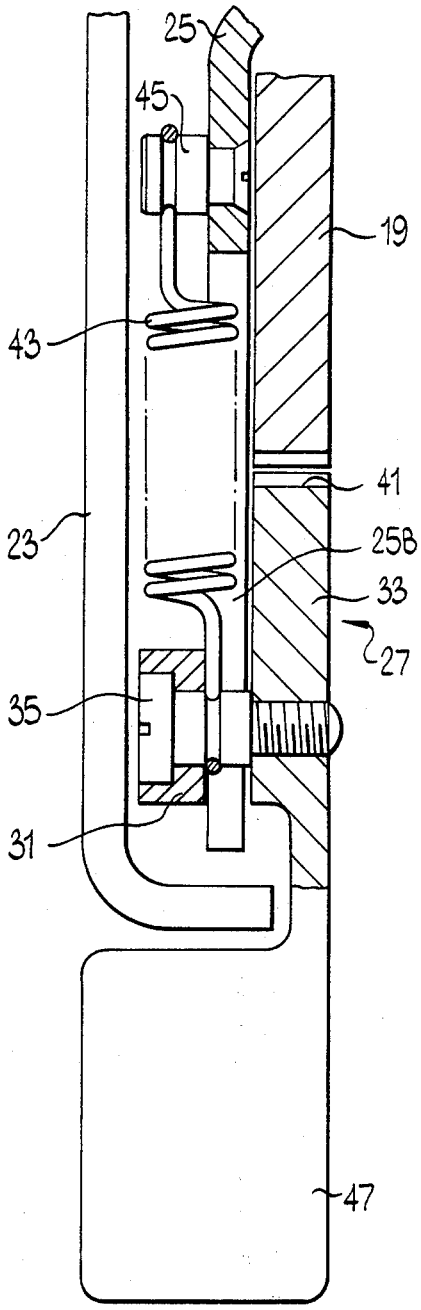

Referring now particularly to FIG. 3, when it is desired to lower the visor 13 pressure is applied to the knob 47 in such a direction (upwards in FIG. 3) as to cause the operating lever 27 to rock about the pivot formed by the reaction surface 49A of slot 39A and projection 37A of plate 33. As a result the toothed surface 41 of plate 33 disengages from the sector 19 so that continued pressure on the knob 47 produces rotation of the members 25 and 27, and hence the visor, about the axis X. When the pressure on the knob 47 is relaxed the spring 43 brings the teeth on plate 33 and sector 19 back into engagement to lock the visor positively in its new position.

To raise the visor 13 pressure is applied to the opposite side of the knob 47, the operating lever 27 then rocking about the pivot formed by the reaction surface 49B of slot 39B and the projection 37B of plate 33 to disengage the toothed surface 41 from the sector 19. The reaction surfaces 49A and 49B are on the lever 25 that constitutes the first member of the second latch part.

It will be appreciated that in the absence of adequate frictional resistance to rotation of the mechanism about axis X the toothed surface 41 will ride over the teeth of sector 19 with undesirable chattering and tooth wear. To provide sufficient resistance to avoid this friction washers (not shown) are suitably employed at the hinge axis X.

I claim:

1. A latch mechanism for controlling the relative movement of two hinged members about an axis comprising:

(A) a first latch part fixed to one of the two hinged members;

(B) a second latch part comprising (i) a first member fixed to the other of said two hinged members, and (ii) a manually operable second member (a) having two spaced portions adapted to contact spaced reaction surfaces on said first member; and (C) a spring arrangement which biasses said spaced portions and reaction surfaces toward contact with one another;

(D) the second member having a surface which engages a surface of the first latch part under the action of the spring arrangement, and (E) the arrangement being such that (i) pressure applied to the manually operable second member of the second latch part is reacted at one or other of the reaction surfaces accordingly as the applied pressure acts in a sense clockwise or counter-clockwise about the hinge axis to cause said second member to pivot against the bias of the spring arrangement about one or the other of its spaced portions with the result that the engaged surfaces are disengaged and (ii) under continuing pressure at its second member the said second latch part moves angularly with respect to the said first latch part.

2. A latch mechanism according to claim 1 wherein the engageable surfaces of the first latch part and the second member of the second latch part are toothed surfaces.

3. A latch mechanism according to claim 1 wherein said first member of the second latch part comprises a planar lever the outside edges of which provide said spaced reaction surfaces, and the second member of the second latch part comprises two plates lying on opposite sides of the planar lever, at least one of which plates has projections which constitute said spaced portions on the second member and provide a gap between the two plates through which said planar member extends.

4. A latch mechanism according to claim 3 wherein said spaced reaction surfaces are provided by the outside edges of the two limbs of a forked portion of said lever and said spring arrangement comprises a spring disposed between the two limbs and anchored at one end to the lever and at the other end to the second member of the second latch member.

5. A latch mechanism according to claim 4 wherein at said second member the spring is anchored by a fixing member which serves to secure the two plates together.

6. A helmet having a visor hinged thereto and a latch mechanism according to claim 1 for controlling relative movement of the visor and helmet.

7. A unit comprising a visor and a latch mechanism according to claim 1 adapted for mounting on a helmet, the visor being secured to said first member of the second part of the mechanism.

* * * * *